US005216796A

United States Patent [19]

Tanaka et al.

[11] Patent Number: 5,216,796

[45] Date of Patent: Jun. 8, 1993

[54] METHOD AND APPARATUS FOR SHORTENING SIZE OF SLIDE FASTENER

[75] Inventors: Shigeru Tanaka; Toshiaki Sawada, both of Toyama, Japan

[73] Assignee: Yoshida Kogyo K.K., Tokyo, Japan

[21] Appl. No.: 871,732

[22] Filed: Apr. 21, 1992

[30] Foreign Application Priority Data

Apr. 25, 1991 [JP] Japan ..... 3-188405

[51] Int. Cl.[5] ..... A41H 37/06; B21D 53/50

[52] U.S. Cl. ..... 29/408; 29/770; 83/921

[58] Field of Search ..... 29/408, 770, 33.2; 83/921

[56] References Cited

U.S. PATENT DOCUMENTS

| | | | |
|---|---|---|---|
| 3,831,474 | 8/1974 | Perlman | 83/921 |
| 4,153,489 | 5/1979 | Moertel et al. | 156/73.3 |
| 4,262,569 | 4/1981 | Yoshieda et al. | 29/770 |
| 4,325,185 | 4/1982 | Kanzaka | 29/770 |
| 4,428,264 | 1/1984 | Shimai | 83/921 |
| 4,866,825 | 9/1989 | Suzuki | 29/770 |

FOREIGN PATENT DOCUMENTS

| | | |
|---|---|---|
| 0172546 | 2/1986 | European Pat. Off. . |
| 2441357 | 11/1979 | France . |
| 2025514 | 3/1979 | United Kingdom . |
| 2095744 | 10/1982 | United Kingdom . |

*Primary Examiner*—P. W. Echols

*Attorney, Agent, or Firm*—Hill, Steadman & Simpson

[57] ABSTRACT

A slide fastener shortening method for shortening a slide fastener with rows of fastener elements made of synthetic resin from a predetermined length of the slide fastener into a desired short length thereof. In an illustrative embodiment, the present invention includes the steps of: inserting removers disposed at the position orthogonal to the fastener tape into the interstice between fastener elements at a position approximately corresponding to the fastener element length required in a product slide fastener of the desired short length, pressing unnecessary fastener elements of the extra length adjacent to the removers along the proper length to thin the fastener elements to permit easy deformation, pulling the slide fastener in the longitudinal direction to strip off the compressed and deformed fastener elements with the removers and to remove them from each fastener tape so as to form space sections free of fastener elements, and cutting them within the space sections into the desired short length to obtain the product slide fastener of the desired short length. This method may also comprise the steps of, stripping the pressed and deformed fastener elements form the fastener tape with the remover so as to form the space sections free of the fastener elements, and cutting the slide fastener within the space sections into the desired short length to obtain the product slide fastener of the desired short length after attaching upper ends to the fastener element rows of the product slide fastener of the desired short length.

5 Claims, 4 Drawing Sheets

METHOD AND APPARATUS FOR SHORTENING SIZE OF SLIDE FASTENER

BACKGROUND OF THE INVENTION

1. Field of the Invention

This invention relates to a slide fastener shortening method and its apparatus for shortening a length of a slider fastener, particularly a slide fastener having rows of fastener elements made of synthetic resin from a predetermined length of the slide fastener into a desired short length thereof.

2.Prior Art

Conventional slide fastener shortening process for shortening the length of the slide fastener in accordance with the stitched garment of the slide fastener, have heretofore been proposed. These conventional processes used various methods and apparatus for removing unnecessary fastener elements from the slide fastener of a predetermined length to form a space section, and involved cutting the slide fastener at the space section into the desired length to provide the product slide fastener of a desired short length. One method for removing the unnecessary fastener elements to form the space section is shown in J P, B no. 48-3222 (Japanese Patent Publication), wherein a method includes the steps of: compressing and deforming leg portions of fastener elements to be thin in order to permit easy deformation; pulling the neighboring fastener tape right and left in a direction orthogonal to the fastener tape; and forcibly drawing and removing the fastener tape from the leg portions of the fastener elements to form the space sections free of fastener elements. Another method is shown in J. P. B. no. 57-61407 (Japanese Patent Publication), and includes the steps of:

holding the fastener tape with beaded portion between a pair of dies provided with protruded blades which are inserted from the back into between the fastener tapes and the leg portions to spread them apart;

pressing interengaging head portions of the fastener elements by moving a punch downwardly;

and striking the protruded blades of the dies into the space between the leg portions of the fastener elements and the fastener tapes to spread the head portions of the fastener elements apart, so as to form space sections free of the fastener elements.

However, the former space section forming method suffers from several drawbacks. For example, when the fastener tapes are pulled left and right in the orthogonal direction to draw the fastener elements forcibly, thinned fastener elements get broken, often leaving a part of the broken fastener elements still adhered to the fastener tapes. And, since each fastener tape is drawn and removed in a direction orthogonal to the longitudinal direction of each fastener chain, the fastener tape is moved in the orthogonal direction and it becomes difficult to continue operating the subsequent cutting process.

The latter space section forming method suffers from the drawback that, since the protruded blades provided with the dies are set to contact the fastener tape surfaces, when the interengaging head portions of the fastener elements are pressed by the punch to strike the protruded blades in the fastener tapes, the fastener tapes are frequently damaged.

SUMMARY OF THE INVENTION

An object of this invention is therefore to overcome the above-described drawbacks and to provide a slide fastener shortening method and apparatus whereby fastener elements can be completely and reliably removed without damaging each fastener tape, so that the subsequent cutting process can be easily and continuously carried out.

Another object of this invention is to provide a method and apparatus for continuously attaching upper ends to the fastener element rows after unnecessary fastener elements are removed from fastener tapes in case the upper ends are required.

In order to perform the above-mentioned object, this invention is intended to provide a slide fastener shortening method for shortening a slide fastener with rows of fastener elements made of synthetic resin from a predetermined length of the slide fastener into a desired short length thereof. In an illustrative embodiment, the present invention includes the steps of:

inserting removers disposed at the position orthogonal to the fastener tape into the interstice between fastener elements at a position approximately corresponding to the fastener element length required in a product slide fastener of the desired short length, pressing unnecessary fastener elements of the extra length adjacent to the removers along the proper length to thin the fastener elements to permit easy removal, pulling the slide fastener in the longitudinal direction to strip off the compressed and deformed fastener elements with the removers and to remove them from each fastener tape so as to form space sections free of fastener elements, and cutting them within the space sections into the desired short length to obtain the product slide fastener of the desired short length.

This method may also comprise the steps of, stripping the pressed and deformed fastener elements from the fastener tape with the remover so as to form the space sections free of the fastener elements, and cutting the slide fastener within the space sections into the desired short length to obtain the product slide fastener of the desired short length after attaching upper ends to the fastener element rows of the product slide fastener of the desired short length.

Moreover, this invention is intended to provide a novel slide fastener shortening apparatus for shortening a slide fastener having rows of fastener elements made of synthetic resin, from a predetermined length of the slide fastener to a desired short length. This invention comprises;

a fastener element removing mechanism which is set in the central portion of a frame and is provided with upper and lower removers to be inserted into the interstices between fastener elements at a position approximately corresponding to the element length of a desired short length slide fastener to remove the pressed and deformed fastener elements, a fastener element pressing mechanism which is disposed in one side of the removing mechanism to press and deform the removing fastener elements, a pulling gripper which is disposed in the other side of the removing mechanism to pull the slide fastener in order to strip off the pressed and deformed fastener elements and to remove them from the fastener tapes, and a cutting mechanism which is also disposed in the other side of the removing mechanism to cut the slide fastener within space sections free of fastener elements into the desired short length.

This apparatus may also comprise;

a pulling mechanism for pulling the slide fastener in order to strip off the pressed and deformed fastener elements by the remover, a cutting mechanism for cutting the fastener tapes within the space sections free of fastener elements at the desired short length, and an upper end molding mechanism which is disposed between the pulling mechanism and the cutting mechanism to attach upper ends to the remaining fastener element rows.

According to the above composition of this invention, a novel and improved method and apparatus are accomplished. Since fastener elements to be removed pressed and deformed to be thin to permit easy removal and are removed from fastener tapes by the removers, they can be reliably removed without damaging the fastener tapes and without leaving a part of the fastener elements on the fastener tapes. And since a slide fastener is pulled in the longitudinal direction to remove the fastener elements, the following cutting process can be easily and continuously carried out.

The processing method moreover accomplishes that the upper ends can be continuously and readily attached to the end portions of fastener element rows after unnecessary fastener elements are removed from the fastener tapes if even the upper ends are required. And the processing apparatus for performing its method efficiently may also be accomplished.

It should be understood that the foregoing relates to only a preferred embodiment of this invention, and that it is intended to cover all changes and modifications of the example of this invention herein chosen for the purposes of the disclosure, as far as they do not constitute departures from the scope of this invention.

DETAILED DESCRIPTION OF THE PREFERRED EMBODIMENTS

Figure 1:
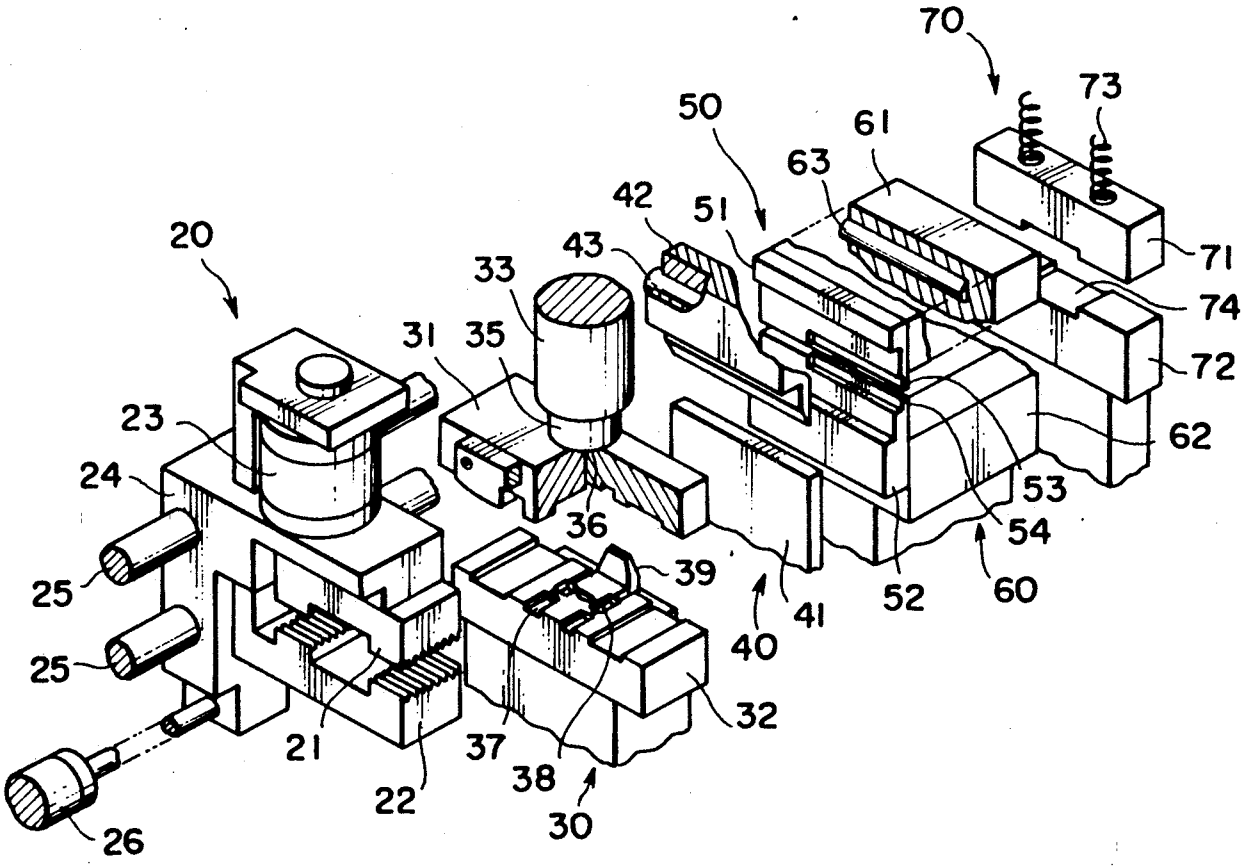
FIG. 1 is a perspective view of a preferred apparatus in accordance with this invention.
Figure 2:
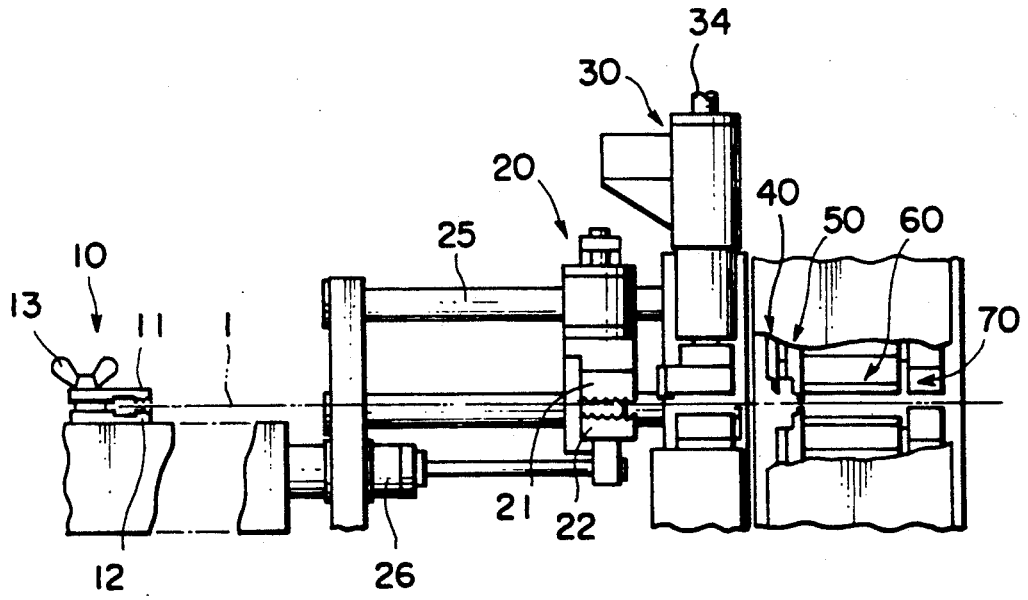
FIG. 2 is a side view of the preferred apparatus.
Figure 7:
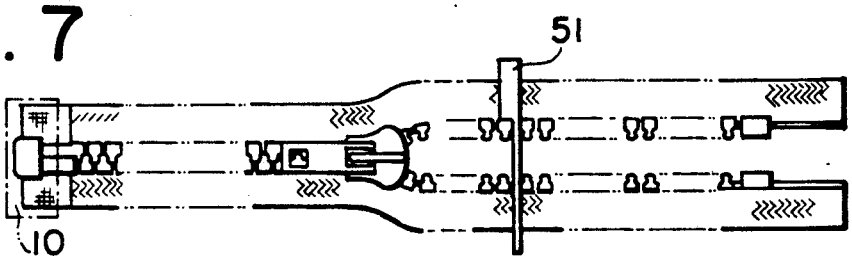
FIG. 7 is a plan view of the slide fastener in one step shown in FIG. 3.
Figure 8:
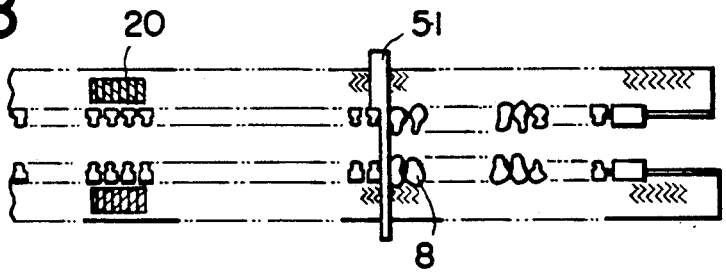
FIG. 8 is a plan view of the slide fastener in the other step shown in FIG. 4.

Referring now to drawings of a slide fastener shortening apparatus according to this invention, this apparatus as shown in FIG. 1 and FIG. 2 includes a slide fastener holder 10, a pulling gripper 20, an upper end molding mechanism 30, a cutting mechanism 40, a fastener element removing mechanism 50, a fastener element pressing mechanism 60, and a slide fastener chain holding mechanism 70. The slide fastener holder 10 as shown in FIG. 2 is disposed in the end part of the apparatus, and holds one end of a processing slide fastener as shown in FIG. 7. The slide fastener holder 10 is displaceable along a longitudinal axis of the apparatus to process the slide fastener at various desired short lengths, and is designed to be able to adjust the length of the slide fastener corresponding to a scale written on the frame. One end of the slide fastener in process is held between a pair of upper and lower holding jaws and clamped by a butterfly nut. The slide fastener tape is released when the process is finished up.

Figure 9:
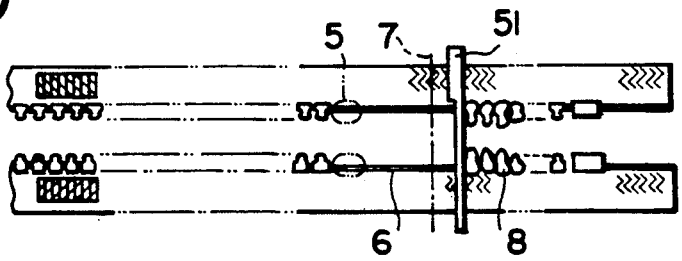
FIG. 9 is a plan view of the slide fastener in the further step shown in FIG. 5.

The pulling gripper 20 is designed to pull a slide fastener 1 in the longitudinal direction in order to strip off pressed and deformed fastener elements 8 (as shown in FIG. 9) by removers 51, 52 of a fastener element removing mechanism 50 described later) to remove them from a fastener tape 2. The pressed and deformed fastener elements are processed in the element pressing mechanism 60 (also described later). This pulling gripper 20 is composed of upper and lower gripper jaws 21, 22 and a hydraulic cylinder 23 for moving the lower gripper jaw 22 up toward the gripper jaw 21. A slider 24 equipped with the upper and lower gripper jaws 21, 22 and the hydraulic cylinder 23 is guided along two guides 25 disposed in parallel in the longitudinal direction of the shortening apparatus, and reciprocates along with the movement of the hydraulic cylinder 26. In gripping the slide fastener 1, instead of displacing the lower gripper jaw 22 toward the upper gripper jaw 21 to grip the slide fastener 1 between them, the upper and lower grippers 21, 22 may be displaced toward each other, or the upper gripper jaw 21 may be displaced toward the lower gripper jaw 22.

The upper end molding mechanism 30 is designed to attach upper ends 5 to the end portions of the remaining fastener element rows as shown in FIG. 9 after the fastener elements 18 are removed and to injection-mold the synthetic resin ends 5 so as to attach the upper ends.

This molding mechanism 30 is provided with a metal mold composed of an upper mold 31 and a lower mold 32. The lower mold 32 is upwardly moved toward the fixed upper mold 31 along with the movement of the hydraulic cylinder (not shown in the drawing) to provide the metal mold of the upper and lower mold 31 and 32. At the predetermined positions of the slide fastener 1 held between the upper and lower molds, a molten synthetic resin in an injection cylinder 33 is injected through a nozzle 35 and a sprue 36 into the metal mold to mold the upper ends 5 onto the fastener tapes 2 so as to produce the upper ends attached to the fastener tapes. In the opposed surfaces of the upper and lower molds 31 and 32 as shown in FIG. 1, they are provided with fastener element setting grooves 37 and cavities 38 disposed adjacent to the setting grooves with which the very end fastener elements 3 of the remaining fastener element rows are interengaged to provide firm positioning. A positioning projection 39 is provided on the front side-face of the lower mold 32 and is inserted between right and left fastener stringer cores to position the upper ends on the right and left fastener tapes 2 precisely before the lower mold 32 is moved upwardly to shut the metal mold.

In attaching the upper ends, instead of molding the upper ends by injecting the synthetic resin to attach them to the fastener tapes, premolded synthetic resin upper ends may be supplied and attached to the fastener tapes by use of supersonic beating or metal upper ends may also be clamped and attached to the fastener tapes. Various upper end molding techniques may be used to attach different types of upper ends against the fastener tapes instead of the injection-molded upper end molding mechanism as shown in FIG. 1. When the upper ends are not required in the slide fastener, the upper end molding mechanism is not required in this shortening apparatus. Even when the upper end molding mechanism is omitted, it is designed to process the slide fastener of the desired short length.

The cutting mechanism 40 is designed to cut the slide fasteners into the desired short length within space sections 6 which are formed by removing compressed and deformed fastener elements with removers 51, 52 of the fastener element removing mechanism 50 (described in detail later), as shown in FIG. 9. An upper cutting punch 42 is downwardly moved toward a lower cutting die 41 by a hydraulic cylinder (not shown in the drawing) to cut the fastener tapes at a cutting line 7. In cutting the fastener tapes, (which are woven or knitted of synthetic resin fibers), since a heater 43 is set in the cutting punch 42, the fastener tapes are heated and cut and cut ends are molten and hardened so as to prevent entanglement of synthetic resin fibers. The fastener tapes may also be molten and cut by use of the supersonic cutting.

The fastener element removing mechanism 50 is designed to remove the fastener elements from the fastener tapes 2 so as to form space sections 6 in shortening the slide fastener 1 to a predetermined length. The slide fastener 9 of the desired short length includes a pair of upper and lower removers 51, 52. This removing mechanism 50 is disposed adjacent to the following fastener element pressing mechanism 60 and is secured to the frame. The upper and lower removers 51, 52 are opened in the front side to allow the fastener tapes 2 to pass therebetween. Then, edges 53, 54 of the removers 51, 52 are oppositely disposed at the interval which is the same as the thickness of the fastener tape 2, as shown in FIG. 1 and FIG. 3.

Figure 3:
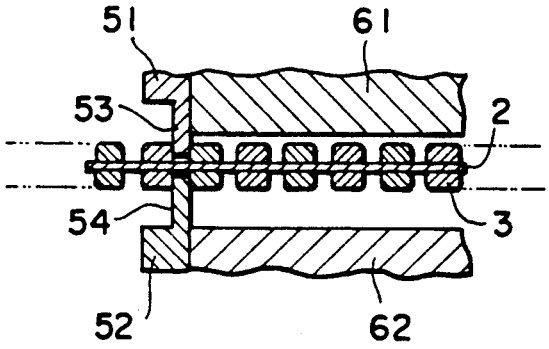
FIG. 3 is a view for illustrating one step of a fastener element removing method according to this invention, wherein the removers are inserted into the interstices between the fastener elements.
Figure 4:
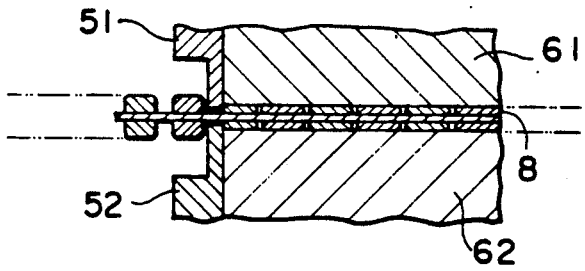
FIG. 4 is a view for illustrating another step of the method, wherein the fastener elements are pressed and deformed.
Figure 5:
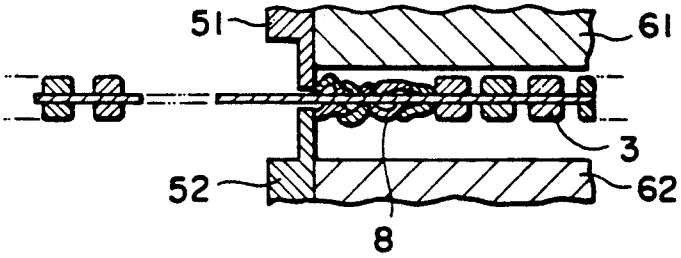
FIG. 5 is a view for illustrating a further step of the method, wherein the pressed and deformed fastener elements are removed.

The edges 53, 54 are formed thinly to be inserted into the interstices between fastener elements as shown in FIG. 3. The thin portions of the removers are continuously formed from the approximately central position to the right side end as shown in FIG. 1 and FIG. 7, and position the fastener type 2 which is inserted into the interstices between fastener elements as desired. The thick portion of the remover 51 is contacted with the base of the fastener element to position the fastener tape 2 as shown in FIG. 7. The slide fastener 1 is inserted and set between the removers 51, 52 so that the fastener elements located in one side of the removers 51, 52 are pressed and deformed for a desired length to form space sections 6 (as shown in FIG. 4) by the fastener element pressing mechanism 60 (described later). Then, the pressed and deformed fastener elements 8 are pulled by the pulling gripper 20 disposed in the other side of the removers 51, 52, and are stripped off by the removers 51, 52 to be removed from the fastener tapes 2 to form the space sections 6 free of fastener elements of the desired length.

The fastener element pressing mechanism 60 is disposed adjacent to one side of the removers 52, 52 of the fastener element removing mechanism 50, and is composed of a fastener element pressing die 61 and a fastener element pressing punch 62 to press and deform fastener elements adjacent to the removers 51, 52 for the length corresponding to the desired length of space sections 6. Each of the fastener elements 3 within the desired length is pressed and deformed to be deformable and thin to provide easy removal from the fastener tape 2. The fastener elements are pressed and deformed by applying the press die 61 and the press punch 62 up and down to repeatedly impact each fastener element. The punch and die are actuated by a hydraulic cylinder (not shown in the drawings) as shown in FIG. 4. The opposed surfaces of the element pressing die 61 and the element pressing punch 62 are formed as generally flat surfaces. If a heater 63 is set in the element pressing die 61 and the element pressing punch 62, fastener elements made of synthetic resin are softened to produce easy deformation thereof, and to weaken the adhesion of the leg portions thereof to the fastener tape 2, so that the pressed and deformed portions thereof to the fastener tape 2, so that the pressed and deformed fastener elements 8 can be more easily removed.

The slide fastener chain holding mechanism 70 is composed of upper and lower holding portions 71 and 72 to hold the end portion of the slide fastener 1 opposite to the end portion of the slide fastener held by the above-mentioned slide fastener holder 10. The upper holding portion 71 is constantly biased toward the lower holding portion 72 with compression spring 73, and the lower holding portion 72 is moved up and down by a hydraulic cylinder (not shown in the drawings). The opposed surfaces of the upper and lower holding portions 71 and 72 are respectively provided with a recess 74 having a depth corresponding to half of the thickness of the fastener elements. The fastener elements are retained in the recesses so as to provide precise positioning.

The slide fastener shortening apparatus illustrated is designed to shorten the right and left fastener stringer cores simultaneously; however, this apparatus may also be designed to process one fastener stringer core at a time. If upper ends are not required in the slide fastener, the upper end molding mechanism may be ommited.

The processing steps of the slide fastener shortening method according to this invention are illustrated in FIG. 6 to FIG. 10, wherein the process to shorten the slide fastener 1 with a pin-and-box to produce the shortened fastener tapes 9 is described. The apparatus of this invention processes not only the slide fastener tape 1 with a pin-and-box, but also a fastener tape with an upper end or without an upper end, as well as fastener tape in which the pair of the fastener stringers are not engaged.

Figure 6:
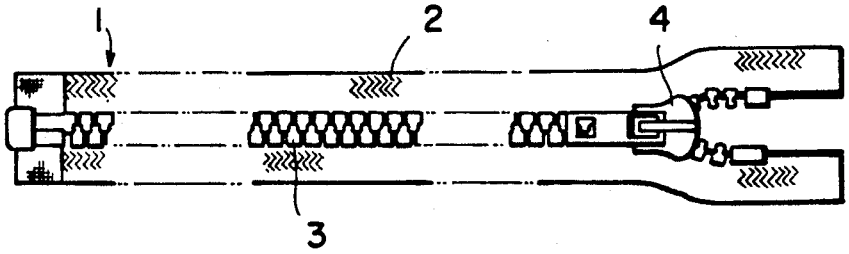
FIG. 6 is a plan view of a processing slide fastener.

First, the slider 4 of the processing slide fastener 1 shown in FIG. 6 is moved toward the backward position of the pulling gripper 20. The length of travel of the gripper 20 is shorter than a desired processing length as shown in FIG. 7. This movement separates the right and left fastener stringer cores provided with the upper stoppers 5 from each other. One end of the processing slide fastener 1 shown in FIG. 7 is held between a pair of holding jaws 11 and 12 of the slide fastener holder 10, which is fixed at the adjusted position to be processed to have the desired length. Next, the upper and lower removes 51, 52 of the element removing mechanism 50 are engaged with the fastener elements. The point of engagement corresponds approximately to the element length required in the product slide fastener of the desired short length and the adjacent fastener elements. The end portions of one side of the fastener stringer cores are inserted into the interstice between the upper and lower removers 51, 52 and come into contact with the positioning stepped portions of the removers 51, 52. The end portions of the separated fastener stringer cores are pressed and held by the slide fastener chain holding mechanism 70. The element pressing mechanism 60 is operated to press the fastener elements 3 from the top and bottom along the desired length for forming the space sections 6 as shown in FIG. 4, and to deform the fastener elements to make the fastener elements thin and easily removable. At the same time, the pulling gripper 20 is displaced toward the upper end molding mechanism 30 to grip the slide fastener. When the fastener element pressing and deforming process is finished, the pulling gripper 20 is displaced toward the slide fastener holder 10 to move the ends of the fastener stringer cores against the compression spring force while holding it between upper and lower holding portions 71, 72 of the slide fastener chain holding mechanism 70, and to pull the stringer cores.

Figure 10:
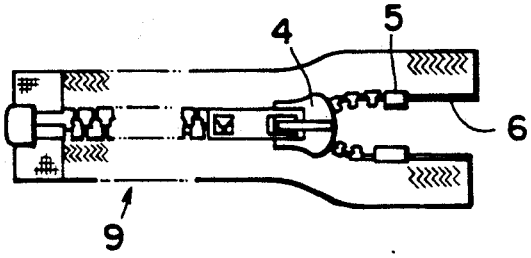
FIG. 10 is a plan view of a product slide fastener.

As shown in FIG. 9, the pressed and deformed fastener elements 8 are stripped off from the fastener tapes 2 by the upper and lower removers 51, 52 of the element removing mechanism 50 so as to form the space sections 6 free of fastener elements. The pulling gripper 20 is displaced to the predetermined position and the upper ends 5 are attached to the space sections 6 adjacent type the fastener elements of the remaining element rows as shown in FIG. 9 in simultaneous or continuous operation of the upper end molding mechanism 30 and the cutting mechanism 40. The slide fastener is cut at the desired length to finish up the shortening process. The slide fastener 9 shortened to the desired length and finished up is released from the pulling gripper 20 and the slide fastener holder 10 as shown in FIG. 10. Finally, the product slide fastener is taken out, and the left slide fastener portion held between the removers 51, 52 of the element removing mechanism 50 are removed. Thereafter, another slide fastener may be introduced into the apparatus in order to undergo the shortening process.

As described, the slide fastener shortening process may be carried out manually. In this process, one end portion of the processing slide fastener is gripped in the position-adjusted slide fastener holder 10 and the removers 51, 52 of the element removing mechanism 50 are inserted into the interstices between the fastener elements at the desired positions. The other end of the processing slide fastener is held in the slide fastener chain holding mechanism 70, and thereafter the process is done automatically. If upper ends are not required in the slide fastener, the slide fastener is cut at the desired position without the upper ends, and taken out as the finished product.

What is claimed:

1. A slide fastener shortening method for shortening a slide fastener having rows of fastener elements made of synthetic resin from a predetermined length of said slide fastener into a desired short length thereof comprising the steps of:

inserting removers into interstices between fastener elements at a position approximately corresponding to the element length required in a product slide fastener of the desired short length;

pressing and deforming unnecessary fastener elements on one side of said removers for the desired length to make said fastener elements thin to permit easy removal thereof, pulling said slide fastener in a longitudinal direction to strip off pressed and deforemd fastener elements so as to form space sections, and cutting said slide fastener within said space sections into a desired short length to obtain a product slide fastener of a desired short length.

2. A slide fastener shortening method according to claim 1, wherein said pressed and deformed fastener elements are stripped by said removers and removed from said fastener tape to form said space sections free of said fastener elements and, said slide fastener is cut within said space sections into the desired short length to be said product slide fastener of the desired short length after upper ends are attached to end portions of remaining fastener element rows.

3. A slide fastener shortening apparatus for shortening a slide fastener having rows of fastener elements made of synthetic resin, from a predetermined length of said slide fastener to a desired short length thereof comprises;

a fastener element removing means which is set in the central portion of a frame and is provided with upper and lower removers for inserting into interstices between fastener elements at a position approximately corresponding to the element length required in a product slide fastener of the desired short length to remove pressed and deformed fastener elements, a fastener element pressing means which is disposed on a first side of said removing means to press and deform the fastener elements to be removed, a pulling gripper which is disposed on a second side of said removing means to pull said slide fastener in order to strip off said pressed and deformed fastener elements and to remove them from said fastener tapes, and a cutting means which is disposed on said second side of said removing means to cut said slide fastener within space sections free of fastener elements formed by removal of said fastener elements into the desired short length.

4. A slide fastener shortening apparatus according to claim 3, wherein an upper end molding means for attaching upper ends to end portions of fastener elements rows is disposed between said pulling gripper and said cutting means, said pulling gripper being operative to pull said slide fastener in order to strip off said pressed and deformed fastener elements by said removers to remove them from said fastener tapes, and said cutting means being operative to cut said fastener tapes within said space sections free of fastener elements formed by removal of said fastener elements into the desired short length.

5. A slide fastener shortening apparatus according to claim 3, wherein said upper end molding means is constructed to injection mold said upper ends onto the end portions of the fastener element rows left in said fastener tapes after said pressed and deformed fastener elements are removed from said fastener tapes.

* * * * *